US005755188A

United States Patent [19]

Phelps

[11] Patent Number: 5,755,188

[45] Date of Patent: May 26, 1998

[54] VARIABLE PRESSURE ONCE-THROUGH STEAM GENERATOR FURNACE HAVING ALL WELDED SPIRAL TO VERTICAL TUBE TRANSITION WITH NON-SPLIT FLOW CIRCUITRY

[75] Inventor: Calvin E. Phelps, Akron, Ohio

[73] Assignee: The Babcock & Wilcox Company, New Orleans, La.

[21] Appl. No.: 434,888

[22] Filed: May 4, 1995

[51] Int. Cl.[6] ..... F22B 37/06; F22B 37/10

[52] U.S. Cl. ..... 122/511; 122/6 A; 122/235.11; 122/235.12; 122/235.14; 122/235.15

[58] Field of Search ..... 122/6 A, 235.11, 122/235.14, 235.15, 235.23, 510, 511, 235.12

[56] References Cited

U.S. PATENT DOCUMENTS

| | | | |
|---|---|---|---|
| 2,725,042 | 1/1955 | Schroeder | 122/235.11 |
| 4,473,035 | 9/1984 | Gorzegno | 122/235.14 |
| 4,987,862 | 1/1991 | Wittchow et al. | 122/6 A |
| 5,347,955 | 9/1994 | Wittchow | 122/6 A |
| 5,560,322 | 10/1996 | Fitzgerald | 122/6 A |

*Primary Examiner*—Henry A. Bennett
*Assistant Examiner*—Jiping Lu
*Attorney, Agent, or Firm*—Daniel S. Kalka; Robert J. Edwards

[57] ABSTRACT

A once-through steam generator furnace having single pass non-split fluid flow circuitry to prevent steam-water separation with a one to one connection of smaller diameter tubes of the lower furnace spiral tube assembly being connected to the larger diameter vertical tubes of the upper furnace assembly through a reducing tube connecting spiral tubes angled to provide common centerlines with vertical tubes when the spiral tube centerlines are routed vertically.

10 Claims, 2 Drawing Sheets

VARIABLE PRESSURE ONCE-THROUGH STEAM GENERATOR FURNACE HAVING ALL WELDED SPIRAL TO VERTICAL TUBE TRANSITION WITH NON-SPLIT FLOW CIRCUITRY

BACKGROUND OF THE INVENTION

1. Field of the Invention

The present invention relates to steam generators of the Once-Through or "Benson" type also known as the Universal-Pressure boilers which have spiral and vertical flow furnace circuitry in general and in particular to such circuitry having an all welded transition zone for such spiral to vertical flow circuitry.

2. Description of the Related Art

The Once-Through boiler derives its name from the fact that it was developed to be applicable functionally at all commercial temperatures and pressures, subcritical and supercritical.

Prior art variable operating pressure once through boilers or steam generators used furnace tube circuitry wherein the heated fluid flows from spiral furnace tubing located around the total perimeter of the lower part of the generator to vertical tubing located in the upper part of the generator. Headers, bifurcates, trifurcates, bottles, or other fittings were located in the transition zone of the boiler and were used to split the fluid from the spiral tubes into a greater number of vertical tubes. Thus fluid flow leaving any one spiral tube was split into two or more paths.

It was necessary, when splitting or mixing a subcritical pressure steam-water mixture flow path, as when transitioning spiral tubing to vertical tubing, that the downstream component receiving the flow be designed for steam-water separation. This required added fluid flow pressure loss to be built into the downstream component to ensure its static stability. Tubes that receive all water, or a mixture with significantly less than average inlet steam quality, may not circulate sufficiently. The flow may stagnate, reverse, oscillate or natural recirculation may occur within the component. All of these cause furnace material to overheat if the pressure loss was not designed into the component to ensure sufficient forward circulation. The additional pressure loss required for static stability for the prior art designs caused higher plant heat rates due to the additional energy consumed by the boiler feedwater pump-drive. The additional pressure loss caused all upstream components including the lower furnace, economizer and feedwater system to the boiler feedwater pump to be designed for a higher pressure, and thus thicker walled pressure parts at additional costs. These split flow circuitry designs caused steam-water separation and resulted in some tubes receiving all steam, or a high quality steam mixture. The result caused the upper furnace, including the furnace outlet headers and the mechanical supports to be designed for an elevated temperature since the tubes receiving all steam absorbed enough heat to be significantly superheated over saturated steam thermodynamic conditions. The tube material had less strength at higher temperatures and hence they had to be thicker, more structurally supported, and upgraded to a higher strength alloy material. The upper furnace enclosure tubes and membranes, and screen tubes also had to be upgraded to a higher oxidation resistant alloy material due to the higher design temperatures.

Fluid flow furnace circuitry for once-through steam generators connected one number of lower furnace spiral tubes to a greater number of upper furnace vertical tubes for variable furnace pressure operation. The lower and upper furnace were designed with a different number of tubes so that the fluid flow paths were connected through a transition zone by splitting the flow from each spiral tube as it passed to the upper furnace vertical tubes by using headers, bottles, bifurcates, trifurcates, or other fittings for the transition that is sometimes known as a fluid mix or distribution zone.

However, a reliable and cost effective transition was needed to provide the connection between the spiral and vertical tubes with a non-split fluid flow feature for the once-through steam generator furnace circuitry. This transition would prevent steam-water separation problems.

SUMMARY OF THE INVENTION

The present invention is directed to solving the problems associated with prior art flow circuits as well as others by providing an all welded, non-split fluid flow, single fluid pass transition assembly for connecting the lower furnace spiral tubes to the upper furnace vertical tubes for a once-through steam generator designed for variable furnace pressure operation so that the fluid flow paths can be connected on a one to one basis without splitting flow from any spiral tube as it passes to the upper furnace. The lower furnace tube outside and inside diameter dimensions will be less than the upper furnace tube inside and outside diameters and a tube swage or reducer fitting is thus provided for the weld joint. The transition zone is made to be of flue gas tight construction by welding closure plates to the transition, upper and lower furnace tubes, and membrane.

The furnace spiral tube angle of inclination from horizontal, the tube centerline dimensions, and the tube sizes are designed so that when the spiral tubes are routed vertically at the transition, the spiral tube centerlines and the vertical tube centerlines are the same dimension.

In view of the foregoing it will be seen that one aspect of the present invention is to provide a less costly and more reliable transition assembly for spiral to vertical tube flow circuitry of a once-through steam generator.

Another aspect of the present invention is to provide a transition assembly for large size vertical tubes to smaller size spiral tubes of a once-through boiler.

Yet another aspect of the present invention is to provide a once-through steam generator furnace transition having spiral tubes that would route vertically along a common centerline with that of the upper furnace vertical tubes.

These and other aspects of the present invention will be more fully understood upon a review of the following description of the preferred embodiment when considered with the accompanying drawing.

DESCRIPTION OF HIE PREFERRED EMBODIMENT

The present description is intended to disclose the preferred embodiment of the present invention but is not intended to limit it thereto.

Figure 1:
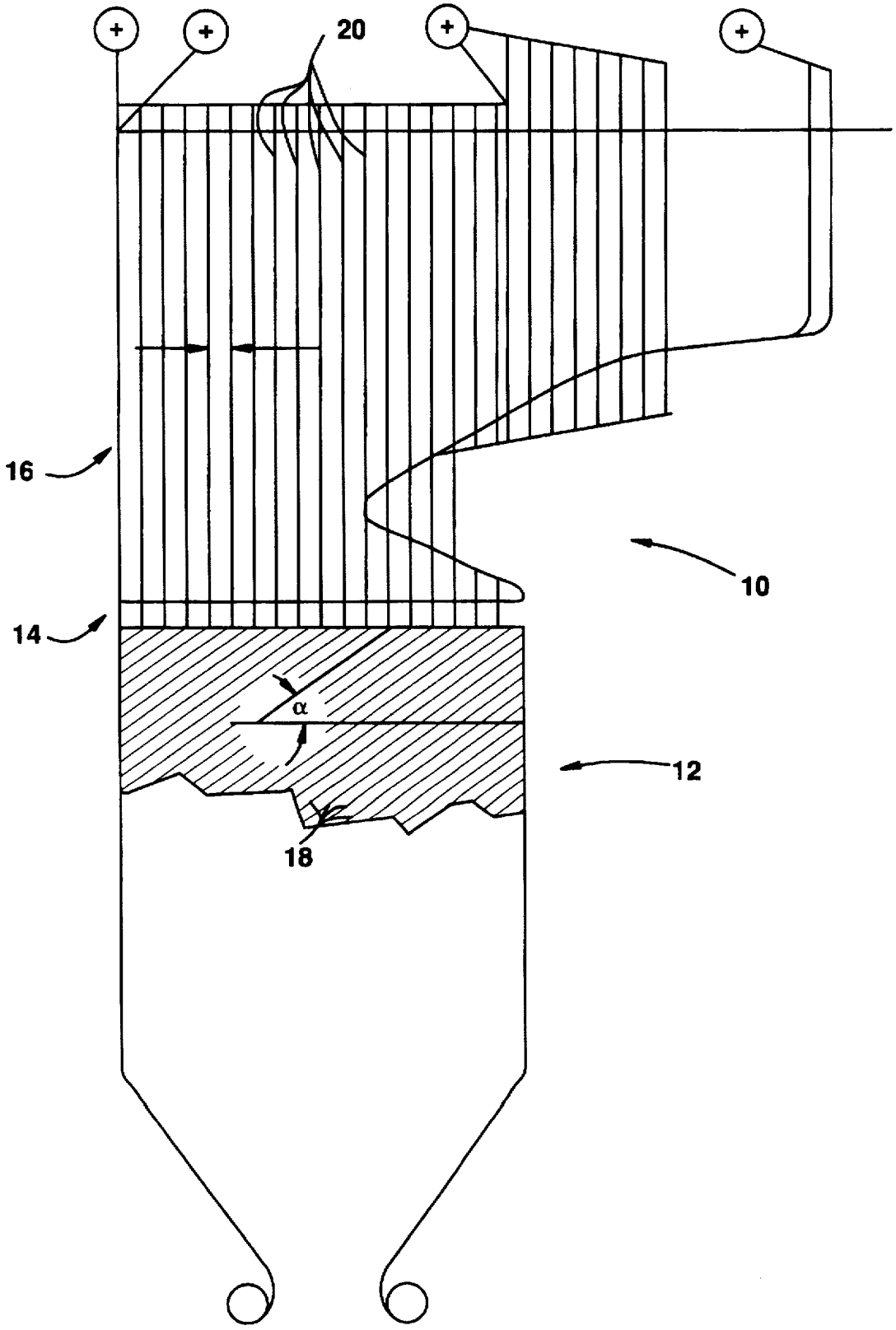
FIG. 1 depicts the upper furnace of a once-through generator having one to one spiral to vertical tube transitions.

FIG. 1 depicts a once-through steam generator assembly 10 which is known as a Universal-Pressure boiler or a "Benson" boiler. There is no recirculation of water within the unit and, for this reason, a drum is not required to separate water from steam. The once-through boiler may be designed to operate at subcritical, supercritical or variable pressures.

The assembly 10 may be a unit complete in itself without auxiliary heat absorbing equipment, or it may constitute a rather small part of a large steam generating complex in which the steam is generated primarily in the furnace tubes, and the convection surface consists of a superheater, reheater, economizer and air heater. In the latter case, a drum-type boiler comprises only the steam drum and the screen tubes between the furnace and the superheater. However, the furnace water-wall tubes, and usually a number of side-wall and support tubes in the convection portion of the unit, discharge steam into the drum and therefore effectively form a part of the boiler.

In the case of the once-through boiler, there is no steam drum, but rather an arrangement of tubes in which steam is generated and superheated. The lower zone 12 has a series of spiral tubes extending around the circumference which are connected through a transition zone or mix zone 14 to a series of greater number vertical tubes in the upper zone 16. Whether the boiler is a drum or a once-through type, whether it is an individual unit or a small part of a large complex, it is necessary in design to give proper consideration to the performance required from the total complex.

In the single pass, non-split fluid circuitry of the present invention the lower furnace spiral tubes (18) connect to the upper furnace vertical tubes (20) in a once-through steam generator designed for variable furnace pressure operation. The upper and lower furnace (12, 16) are designed with the same number of tubes. The fluid flow paths are connected on a one to one basis through the transition zone(14) without splitting flow from any spiral tube as it passes to the upper furnace (16) using a transition assembly which will be described later. Intermediate headers, bottles, bifurcates, trifurcates, or other fittings are thus not required.

Figure 2:
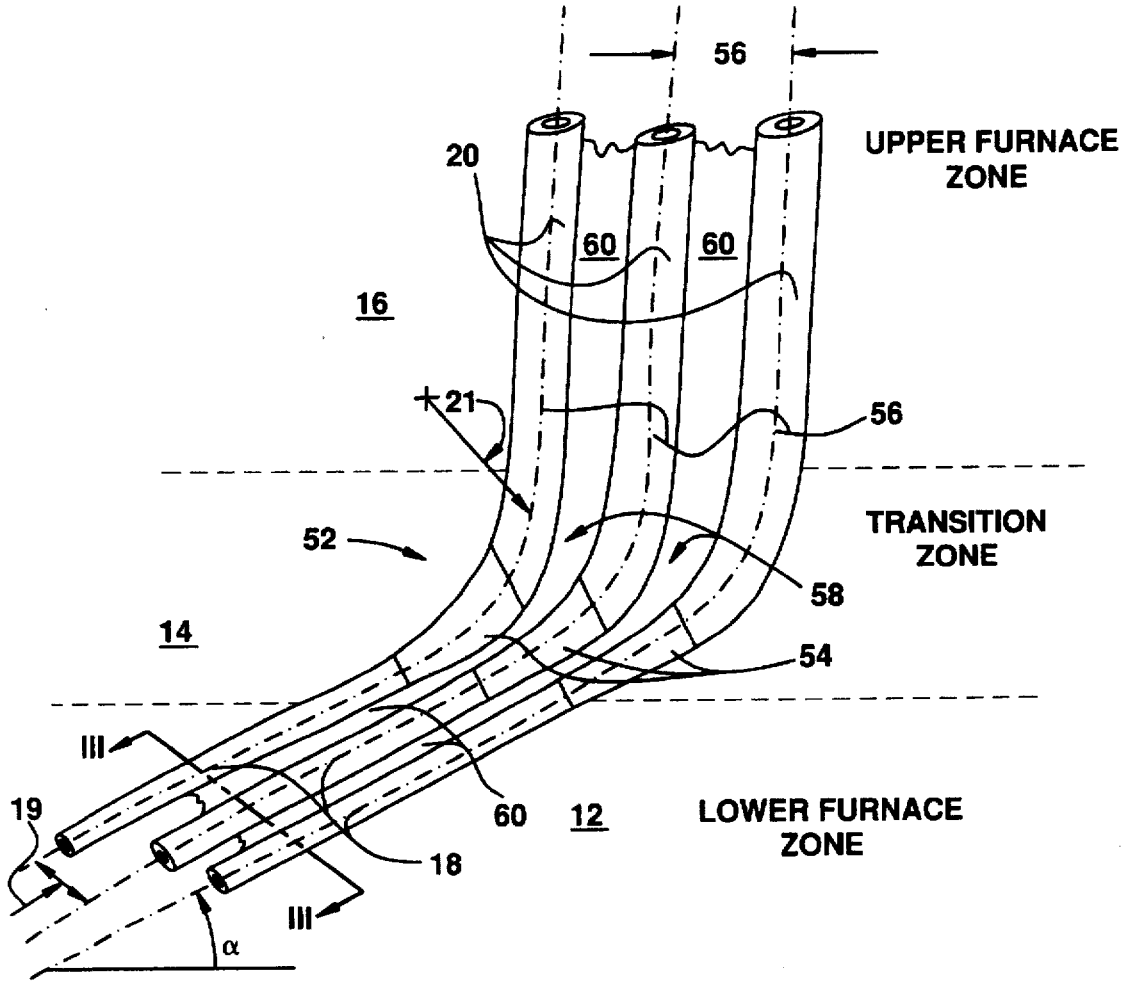
FIG. 2 depicts a transition assembly of the present invention for connecting the vertical tubes to the spiral tubes in the once-through steam generator of FIG. 1.
Figure 3:
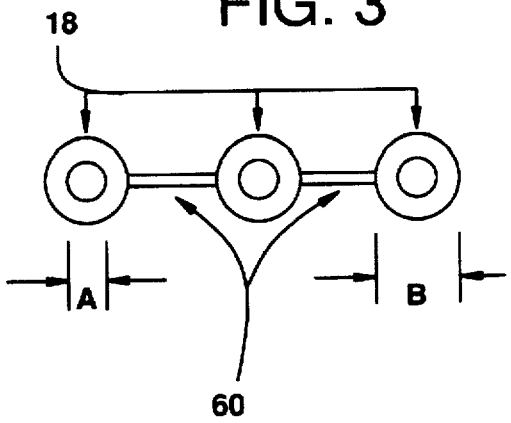
FIG. 3 is a sectional view taken at section III—III of FIG. 2.

With particular reference to FIG. 2, it will be seen that a transition assembly 52 is located in the transition zone 14 to connect the vertical tubes 20 to the spiral tubes 18 on a one to one basis by individual connecting tubes 54. The transition zone 14 is made gas tight by welding closure plates 58 to the tubes 18, 20 and 54 and membranes 60 found between the tubes in zones 12 and 16.

Since the inside and outside dimensions of the spiral tubes 18 are smaller than that of the vertical tubes 20, the connecting tubes 52 must provide a reduction from the vertical 20 to spiral tubes 18. The tubes 52 are either made as reducer fittings to allow the tubes 18 and 20 to be butt welded at each end around the circumferences to form a seal, in which case, the ends of the vertical tubes 20 are radius bent 21 and trimmed in length to provide an in line butt connection with the tube section 52 and the spiral tubes which are angled at the angle a, or the larger tubes 20 are radius bent 21, trimmed in length, and then swaged or reduced in diameters to match the tube ends of spiral tubes 18 for seal welding around the circumference. Specially fabricated tube fittings may also be used for the transition assembly 52.

The once-through boiler 10 design is made with the upper furnace vertical tubes 20 given primary consideration by allowing them to set the number of tubes required for the furnace. The spiral tubes 18 are then designed at an angle a, to inside A and outside B tube diameter dimensions, and to tube centerline spacing dimensions 19 to make the centerlines 56 of both tubes 18 and 20 match in alignment when the centerlines of tube 18 are routed vertically.

Certain modifications and improvements have been deleted herein for the sake of conciseness and readability. It will be understood that all such modifications and improvements are however intended to be within the scope of the following claims.

What is claimed is:

1. A once-through steam generator, comprising:

a series of spiral tubes extending around a lower furnace area of a steam generator;

a series of vertical tubes located in an upper furnace area of the steam generator; and transition means for connecting each of said vertical tubes on a one to one basis to each of said spiral tubes, said transition connecting means being located in a transition zone of the steam generator between the lower furnace area and the upper furnace area, each of said spiral tubes being smaller in diameter than each of said vertical tubes and said transition connecting means being a reducer for connecting each of said vertical and spiral tubes said reducer being a tapered tube member having a smaller and larger diameter end and fitting each of said spiral tubes at the smaller diameter end and fitting each of said vertical tubes at the larger diameter end.

2. A generator as set forth in claim 1 wherein said spiral tubes are angled at an angle α, to inside and outside tube diameter dimensions, and to tube centerline spacing dimensions, to provide a common centerline with the vertical tubes when the spiral tubes are routed vertically.

3. A generator as set forth in claim 1 wherein each of said vertical tubes are radius bent and trimmed in length to conform to an angle α of each of the spiral tubes.

4. A generator as set forth in claim 1 wherein the transition zone is sealed with closure plates welded to said transition connecting means.

5. A generator as set forth in claim 4 wherein said vertical and spiral tubes have membranes formed therebetween and said closure plates are welded thereto.

6. Fluid flow circuitry for a once-through steam generator, comprising:

a series of vertical tubes located in an upper furnace area of a steam generator having a first larger diameter;

a series of spiral tubes located in a lower furnace area of the steam generator having a second smaller diameter; and transition means for connecting each of said vertical tubes to each of said spiral tubes on a one to one basis, said transition connecting means including a reducing tube for connecting each of said vertical and spiral tubes in a transition zone, said transition zone being sealed with closure plates welded to each of said reducing tubes.

7. Fluid flow circuitry for a once-through steam generator as set forth in claim 6 wherein said spiral tubes are angled at an angle α to provide a common centerline with the vertical tubes when the spiral tube centerlines are routed vertically.

8. Fluid flow circuitry for a once-through steam generator as set forth in claim 7 wherein said reducing tube is a tapered tube member having a smaller and a larger diameter end and fitting each of said spiral tubes at the smaller diameter end and each of said vertical tubes at the larger diameter end.

9. Fluid flow circuitry for a once-through steam generator as set forth in claim 8 wherein said vertical tubes are radius bent, trimmed in length, and end swaged to conform to butt ends and to the angle $\alpha$ of the spiral tubes.

10. Fluid flow circuitry for a once-through steam generator as set forth in claim 6 wherein said vertical and spiral tubes have membranes formed therebetween and said closure plates are welded thereto.

* * * * *